US011472204B2

(12) United States Patent
Moehringer

(10) Patent No.: US 11,472,204 B2
(45) Date of Patent: Oct. 18, 2022

(54) PRINTING SUBSTRATE TRANSPORT DEVICE AND PRINTING MACHINE

(71) Applicant: HEIDELBERGER DRUCKMASCHINEN AG, Heidelberg (DE)

(72) Inventor: Markus Moehringer, Weinheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 527 days.

(21) Appl. No.: 16/580,585

(22) Filed: Sep. 24, 2019

(65) Prior Publication Data

US 2020/0094587 A1 Mar. 26, 2020

(30) Foreign Application Priority Data

Sep. 26, 2018 (DE) ..... 10 2018 216 405.3

(51) Int. Cl.
*B65H 5/02* (2006.01)
*B41J 11/00* (2006.01)

(52) U.S. Cl.
CPC ..... *B41J 11/007* (2013.01); *B41J 11/0085* (2013.01)

(58) Field of Classification Search
CPC ..... B41J 11/007; B41J 11/0085; B65H 5/02; B65H 5/08; B65H 5/224
See application file for complete search history.

(56) References Cited

U.S. PATENT DOCUMENTS

| | | | | |
|---|---|---|---|---|
| 4,265,765 | A * | 5/1981 | Gallottini | B01D 33/04 210/401 |
| 5,080,341 | A | 1/1992 | Luethy | |
| 6,406,017 | B1 | 6/2002 | Yaneda | |
| 6,443,443 | B1 * | 9/2002 | Hirth | B65H 29/686 271/10.07 |
| 6,588,580 | B2 * | 7/2003 | Janzen | B65G 17/323 271/18.1 |
| 6,874,300 | B2 | 4/2005 | Di Lauretis et al. | |
| 7,980,558 | B2 * | 7/2011 | Moore | B41J 11/06 198/803.5 |
| 9,010,753 | B2 * | 4/2015 | Shibasaki | B65H 31/36 271/274 |
| 11,274,006 | B2 * | 3/2022 | Veis | B65G 21/2036 |
| 2009/0174138 | A1 * | 7/2009 | Abe | B65G 21/2036 271/276 |
| 2018/0104626 | A1 * | 4/2018 | Mikkola | B01D 33/056 |

FOREIGN PATENT DOCUMENTS

| | | |
|---|---|---|
| DE | 60014262 T2 | 10/2005 |
| DE | 60204133 T2 | 2/2006 |
| EP | 0405107 A1 | 1/1991 |

* cited by examiner

*Primary Examiner* — Thomas A Morrison
(74) *Attorney, Agent, or Firm* — Laurence A. Greenberg; Werner H. Stemer; Ralph E. Locher

(57) ABSTRACT

A transport device for transporting printing substrates includes a conveyor belt that is supported on its inner side by revolving profiles. Each profile has grooves, at least one of which has a first bore and a second bore. A vacuum is applied to the first bore and the second bore is in air-conducting connection with a longitudinal groove in a slide so that suction air flows out of the longitudinal groove, through the at least one groove and into the first bore. A printing machine is also provided.

9 Claims, 6 Drawing Sheets

PRINTING SUBSTRATE TRANSPORT DEVICE AND PRINTING MACHINE

CROSS-REFERENCE TO RELATED APPLICATION

This application claims the priority, under 35 U.S.C. § 119, of German Patent Application DE 10 2018 216 405.3, filed Sep. 26, 2018; the prior application is herewith incorporated by reference in its entirety.

BACKGROUND OF THE INVENTION

Field of the Invention

The present invention relates to a printing substrate transport device including a conveyor belt. The invention further relates to a printing machine equipped with such a transport device.

Such transport devices are used in printing machines to transport sheets, for instance, which are printed on in the process by an inkjet printing head.

German translation of European Patent DE 600 14 262 T2, corresponding to U.S. Pat. No. 6,406,017 B1, for instance, discloses a transport system for transporting leaf-shaped paper. The paper is transported by a belt in which suction holes are formed. The belt runs over a platen chamber with suction holes formed to be spaced apart from one another at a distance that matches the distance between the suction holes of the belt.

SUMMARY OF THE INVENTION

It is accordingly an object of the invention to provide a printing substrate transport device and a printing machine, which overcome the hereinafore-mentioned disadvantages of the heretofore-known devices and machines of this general type.

With the foregoing and other objects in view there is provided, in accordance with the invention, a transport device for printing substrates, comprising a conveyor belt supported on its inner side by revolving profiles, each of the profiles having grooves and at least one of the grooves having a first bore and a second bore, a vacuum being applied to the first bore and the second bore being in air-conducting connection with a longitudinal groove in a slide so that suction air flows out of the longitudinal groove, through the at least one groove and into the first bore.

An advantage of the transport device of the invention is that by sliding the slide, the profile is easily adjustable to the respective format of the printing substrate while the belt is running. An additional advantage is to be seen in the fact that the grooves that are within a processable minimum printing substrate format and the grooves that are outside the minimum format may be connected to a common vacuum generator, which may apply a common vacuum to the grooves.

Various further developments are possible:

- The grooves may be parallel to a direction of revolution of the profiles.
- The first bore of the at least one groove and first bores of adjacent grooves may form a first row and may branch off a common longitudinal channel.
- The grooves of the first row may be located within the minimum format of the printing substrate.

- The second bore of the at least one groove and second bores of adjacent grooves may form a second row that extends to cover the longitudinal groove.
- The second row grooves adjacent the at least one groove may be located outside the minimum format of the printing substrate.
- A groove cam may be provided to slide the slide in an adjustment direction when the slide passes.
- A cam roller may be fixed to the slide. The cam roller may contact the groove cam when the format is adjusted.
- During normal operation of the machine, there may be space between the cam roller and flanks of the groove cam when the cam roller passes through the groove cam.
- The groove cam may have a first section and a second section and the flanks may converge in the first section and be parallel to one another in the second section.

With the objects of the invention in view, there is concomitantly provided a printing machine that has at least one printing head for inkjet printing and a transport device. The transport device is embodied in accordance with the transport device of the invention or with one of the further developments thereof. The print head is oriented towards the transport device to print on the printing substrate located thereon.

Other features which are considered as characteristic for the invention are set forth in the appended claims.

Although the invention is illustrated and described herein as embodied in a printing substrate transport device and a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
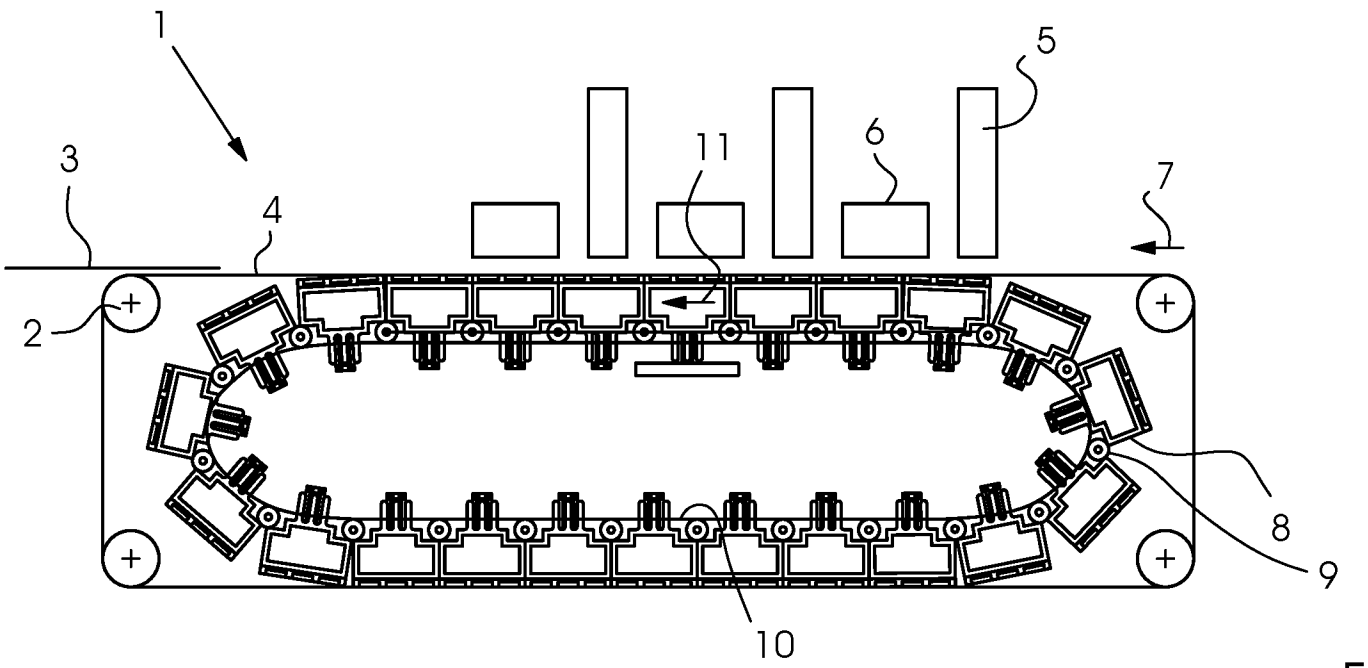
FIG. 1 is a diagrammatic, side-elevational view of a printing machine with a printing substrate transport device.

Referring now to the figures of the drawings in detail and first, particularly, to FIG. 1 thereof, there is seen a printing machine 1 with a transport device 2 for transporting printing substrates 3 in the form of a web or, preferably, in the form of sheets. The transport device 2 includes an endless conveyor belt 4 for transporting the printing substrate 3 in a direction of transport 7 and past one or more printing heads 5 for inkjet printing and, if applicable, past one or more dryers 6, for instance for so-called UV pinning. Beam-shaped profiles 8 are disposed within a path of revolution of the conveyor belt 4. The profiles 8 are connected to one another to form an endless chain. The profiles 8 run in a direction of revolution 11 on rolls 9 on a ring-shaped guide 10. The conveyor belt 4 is a so-called vacuum belt. It has a non-illustrated perforation through which the profiles 8 hold the printing substrate 3 on the conveyor belt 4 by suction.

Figure 2:
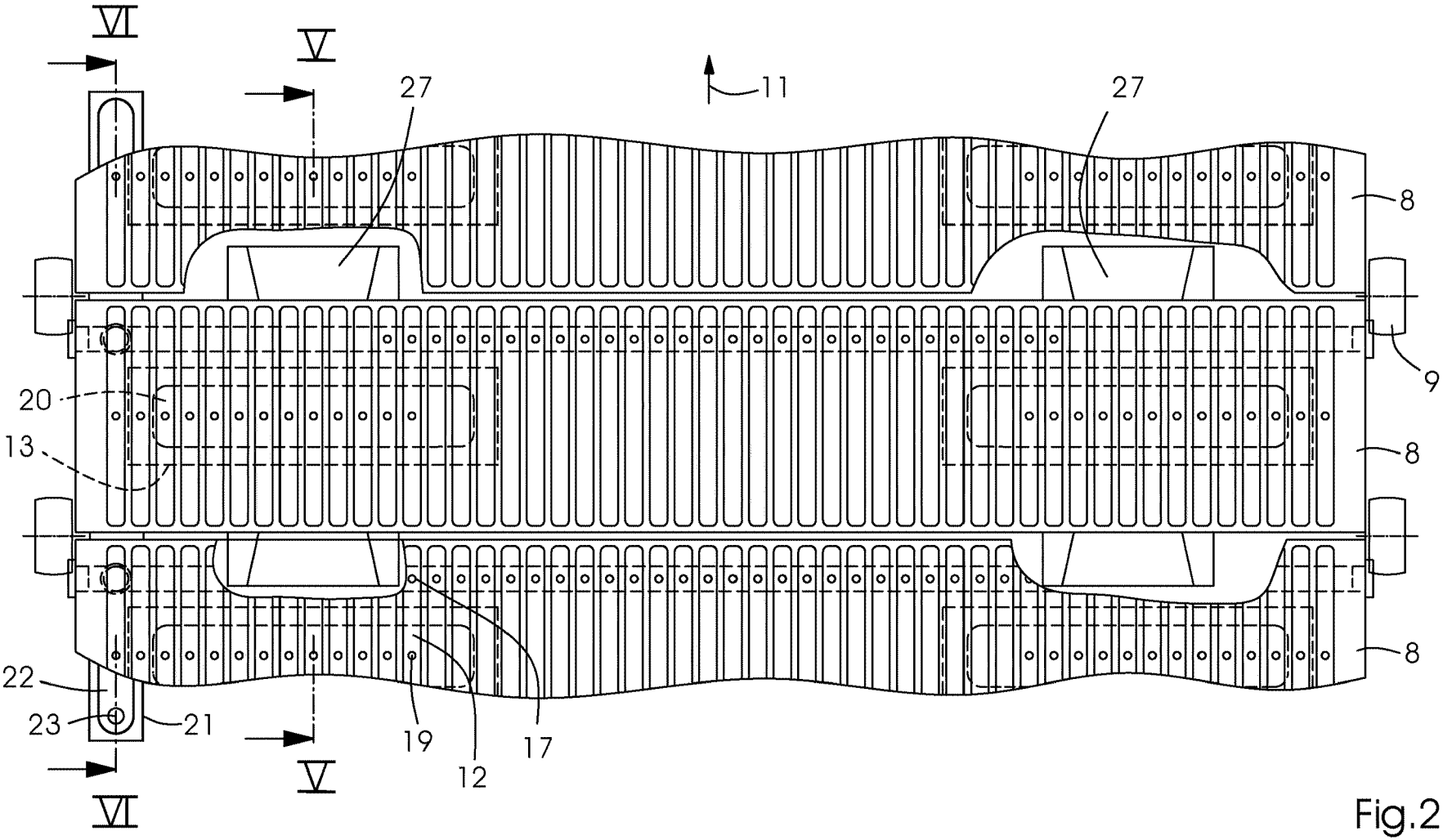
FIG. 2 is a fragmentary, top-plan view of revolving profiles of the transport device.

FIG. 2 illustrates a section of the chain of profiles 8. The conveyor belt 4, which actually covers the profiles 8, is not shown. The length of the profiles 8 and the width of the conveyor belt 4 are to be measured in a direction perpendicular to the plane of the image of FIG. 1 and in a direction horizontal in the plane of the image of FIG. 2. They are at least as big as the width of the printing substrate 3, which is to be measured in the same direction. FIG. 2 is a view of the surface of the profile 8 that faces the inner side of the conveyor belt 4. Grooves 12 that run parallel to the direction of revolution 11 are formed in this surface. The grooves are equidistantly spaced apart from one another and disposed in a row along the profile 8. A vacuum is applied to the grooves 12 from the inside of the profile 8. Thus, with the open side facing the conveyor belt 4, the grooves 12 suck the conveyor belt 4 against the chain of profiles 8. This increases the frictional connection between the conveyor belt 4 and the profiles 8. This feature is advantageous in terms of a frictional driving connection between the conveyor belt 4 and the profiles 8. Moreover, the grooves 12 aspirate the printing material 3 through the aforementioned perforation of the conveyor belt 4.

Figure 3:
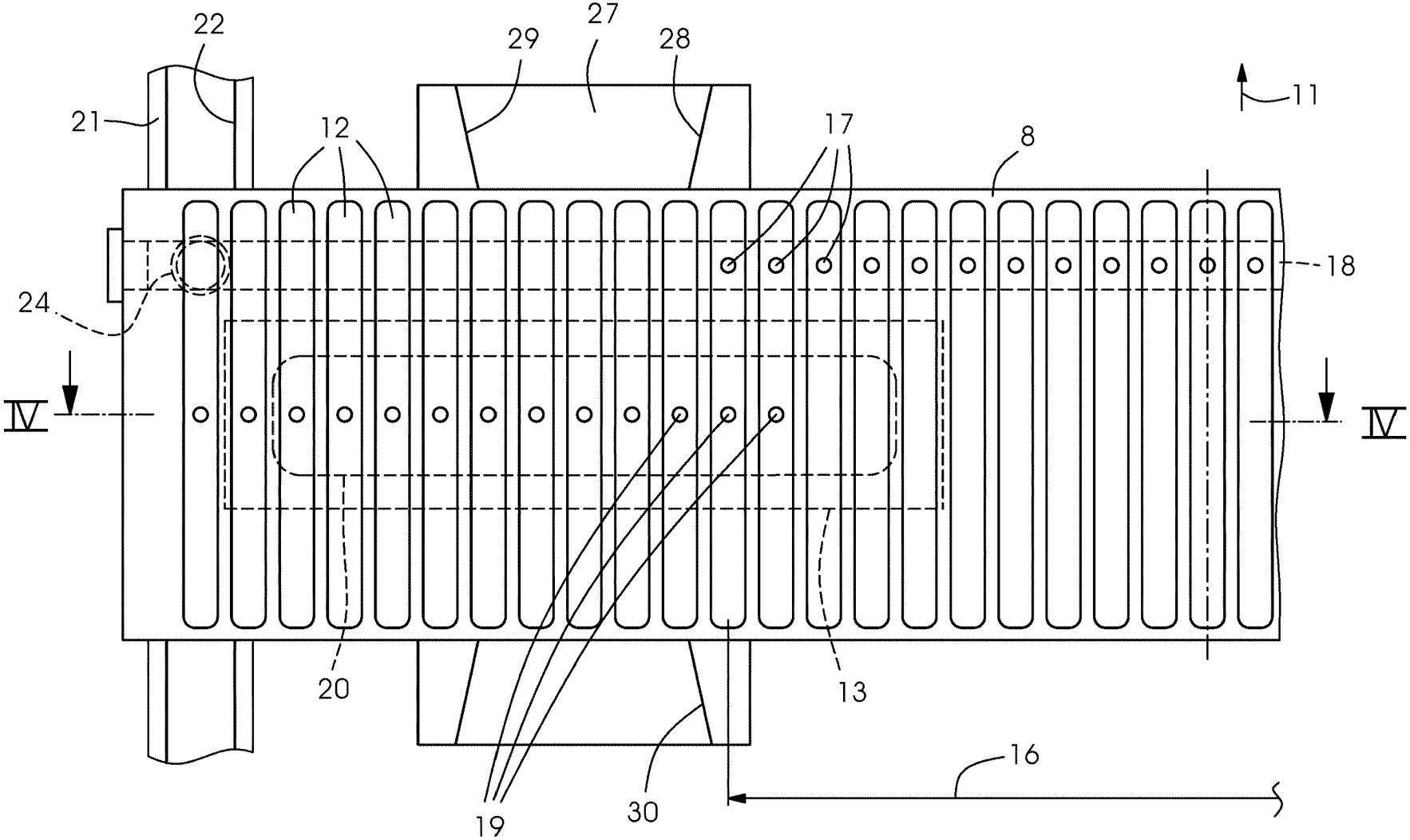
FIG. 3 is an enlarged, fragmentary, top-plan view of a section of one of the revolving profiles.
Figure 4:
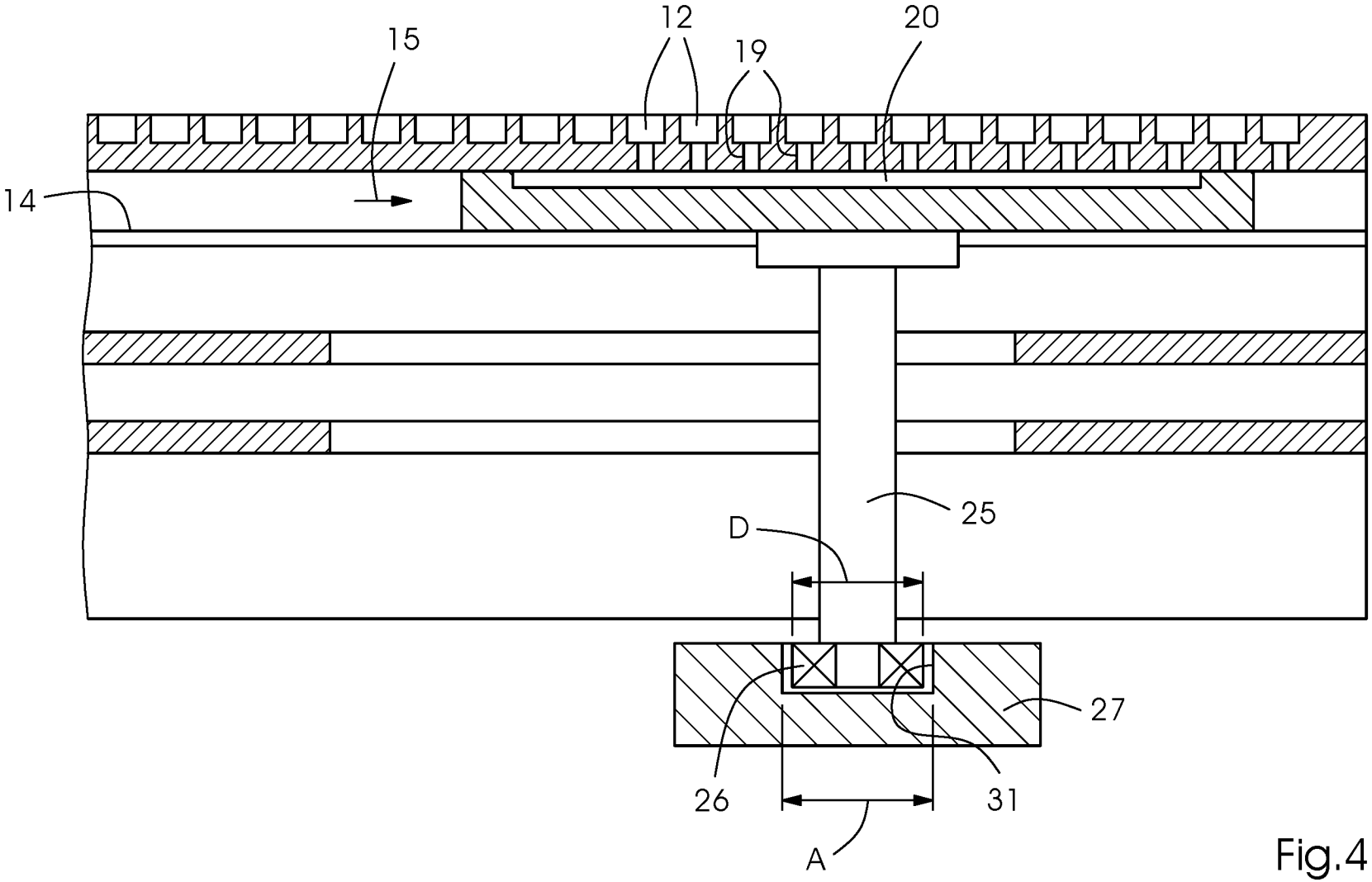
FIG. 4 is a sectional view taken along the line IV-IV of FIG. 3, in the direction of the arrows.

Two slides 13 are integrated into the respective profiles 8. The slides 13 are disposed in such a way as to be movable towards and away from one another along the row of grooves 12. The slides 13 are disposed in a linear guide 14, which is only shown in FIGS. 4 to 6. The slides 13 adjust the effective suction width of the profile 8 to accommodate the respective format of the printing material 3. FIG. 4 illustrates an adjustment direction of the slide 13 when it is adjusted to accommodate a larger format. Every groove 12 that is located within a minimum format 16 of the printing substrate 3 has a first bore 17 in its base. The first bores 17 form a row and branch off a longitudinal channel 18. Every groove 12 located outside the minimum format 16 has a second bore 19 in its base. The second bores form a row along the linear guide 14. At least one groove 12 has both a first bore 17 and a second bore 19. In the exemplary embodiment shown in FIG. 3, there are two grooves 12 that have a first bore 17 and a second bore 19 each. This information of course only refers to one profile end and one slide 13. FIG. 2 shows that at the other profile end, there are also two grooves 12, each one having two bores 17, 19 that cooperate with the slide 13 there.

In every slide 13 there is a longitudinal groove 20 that covers more or fewer second bores 19 as a function of the format setting of the slide 13. FIGS. 3 and 4 show that the longitudinal groove 20 covers eleven second bores 19 but does not cover the two outermost second bores 19. The grooves 12 with the bores 19 that are covered by the longitudinal groove 20 are connected to the vacuum by the longitudinal groove 20, which is in air-conducting connection with the covered second bores 19. At the illustrated format settings, which accommodate a format that is larger than the minimum format 16, they are active grooves 12. The second bores that are not covered by the longitudinal groove 20 belong to grooves 12 that are outside the set width of the format of the printing substrate 3 to be processed. These grooves 12, which amount to two at every end of the profile in the illustrated exemplary embodiment, are not connected to the vacuum in the longitudinal groove 20 and are thus deactivated.

Figure 6:
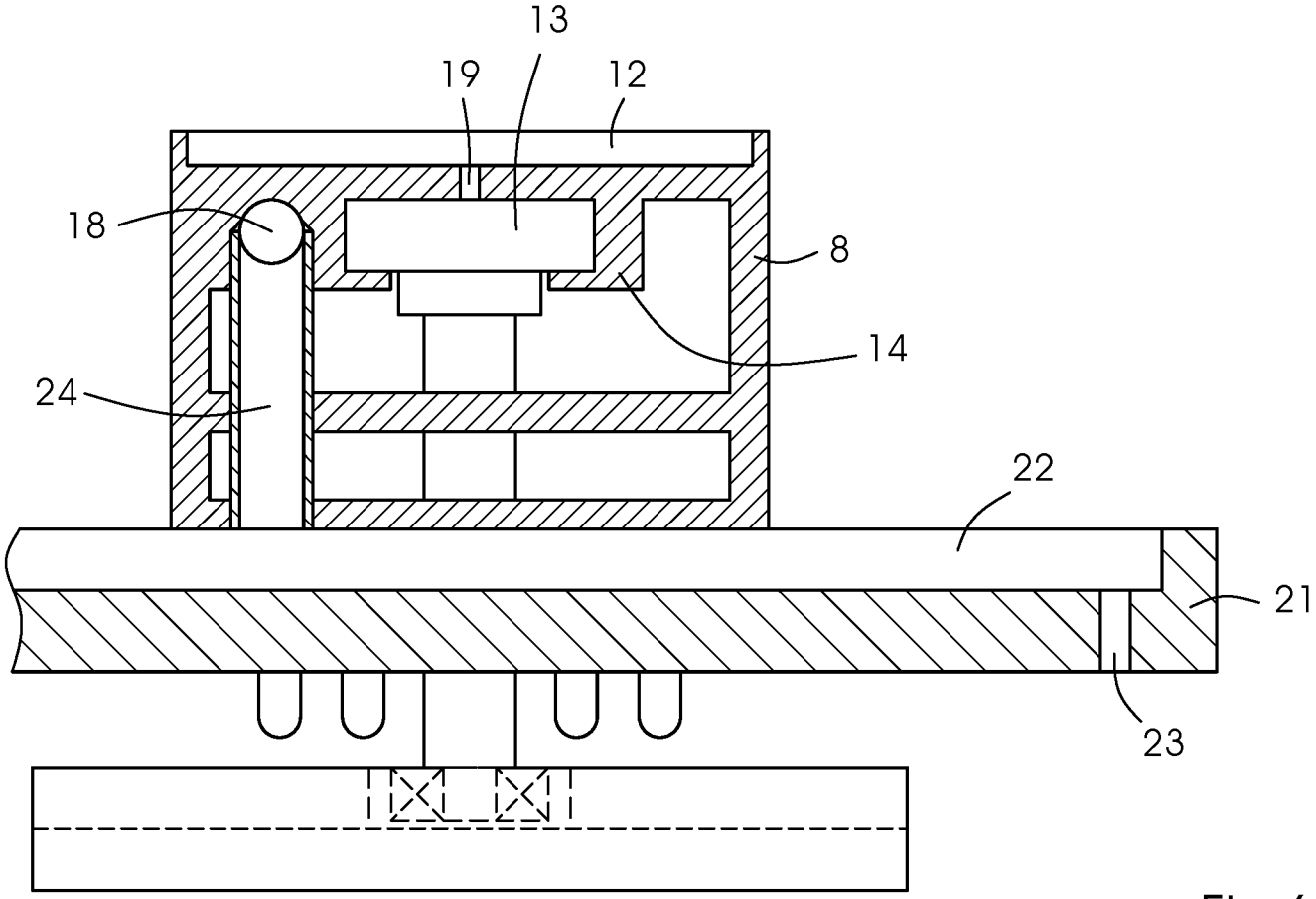
FIG. 6 is a sectional view taken along the line VI-VI of FIG. 2, in the direction of the arrows.

The way in which a vacuum is applied to the active grooves 12 will be described below: In the straight upper section of the ring-shaped guide 10, every profile 8 moves along a rail 21 with a vacuum groove 22 that extends in the direction of revolution 11. A connector 23 connects the vacuum groove 22 to a vacuum generator, which is not shown in the drawing. FIG. 6 shows that the upper side of the profile has the grooves 12 and the underside of the profile 8 is in contact with the rail 21 while the profile 8 runs along the rail 21. There is an air-conducting connection between a connecting channel 24 in the profile 8 and the open side of the vacuum groove 22, allowing suction air to flow out of the longitudinal channel 18 into the vacuum groove 22 through the connecting channel 24. The connecting channel 24 terminates in the longitudinal channel 18 on one end and in the base of the profile 8 on the other end.

The suction air flows from the grooves 12 located within the minimum format 16 through the first bores 17 thereof and into the longitudinal channel 18. At every groove 12 that has the two bores 17, 19, suction air flows out of the second bore 19 through the groove 12 and into the first bore 17. Thus, the longitudinal groove 20 and the longitudinal channel 18 are in a suction-air-conducting connection with one another through every groove 12 that has both bores 17, 19. Suction air flows from the active grooves 12 that are located outside the minimum format 16 into the longitudinal groove 20 of the slide 13 through the respective single second bore 19. This means that these active grooves 12, too, are in a suction-air-conducting connection with the vacuum groove 22.

Figure 5:
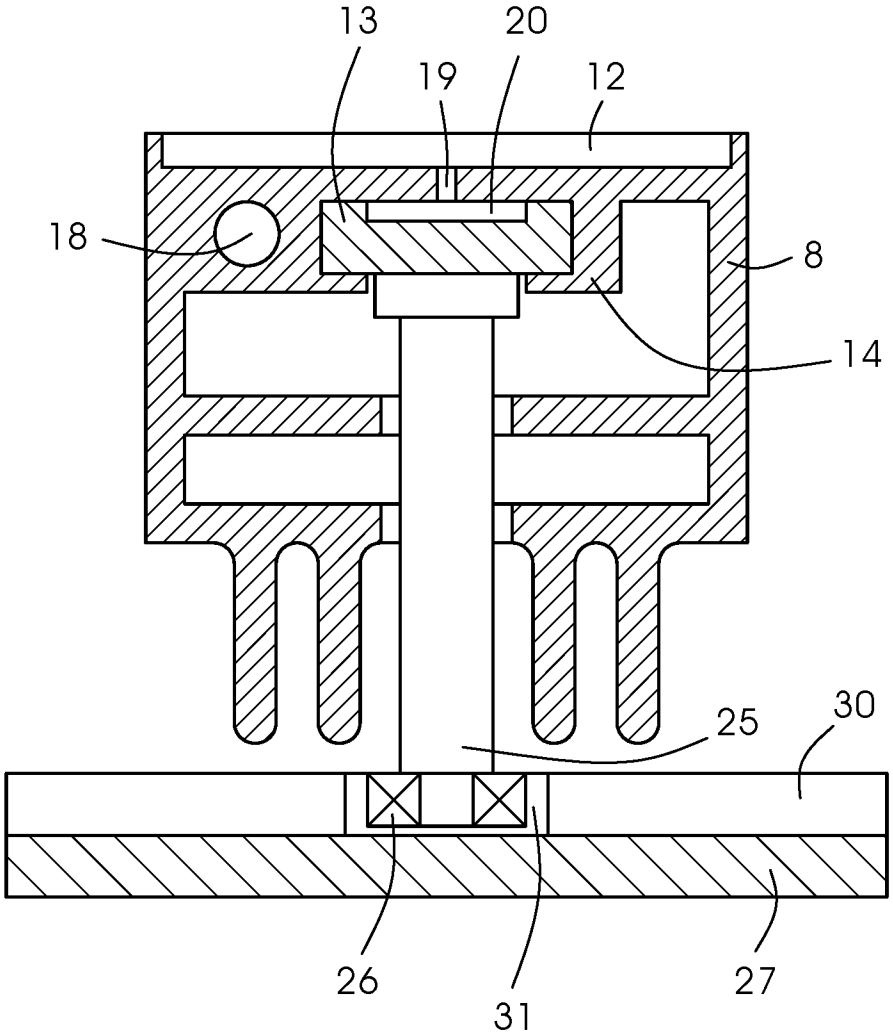
FIG. 5 is a sectional view taken along the line V-V of FIG. 2, in the direction of the arrows.

FIGS. 5 and 6 show that the linear guide 14 is a type of T-groove guide that engages beyond the slide 13 from below. The slide 13 has a journal 25 that protrudes from the base of the profile 8. A cam roller 26, which may be embodied as a rolling bearing, sits on the end of the journal 25. There is a groove cam 27 per every slide 13 of the profile 8 on a fixed point along the path of revolution of the chain of profiles 8. The two groove cams 27 are moved away from one another when an adjustment is made to accommodate a larger printing substrate format and they are moved towards one another when an adjustment is made to accommodate a smaller printing substrate format. The two groove cams 27 may, for instance, sit on a common threaded spindle, with one groove cam 27 connected to the common threaded spindle by a left-hand thread and the other groove cam 27 connected to the common threaded spindle by a right-hand thread.

The inside of every groove cam 27 has a right-hand flank 28 and a left-hand flank 29 in terms of the direction of revolution 11. Starting from the entry side of the groove cam 27, where the cam roller 26 enters the groove cam 27 (at the bottom in FIG. 3), the groove cam 27 has a first section 30 followed in the direction of revolution 11 by a second section 31. In the first section, the flanks 28, 29 converge towards the second section 31 to center the cam roller 26 as it enters. In the second section 31, the flanks 28, 29 are parallel to one another and spaced apart from one another by a distance A that is greater than a diameter D of the cam roller 26. The second section 31 may be followed by a third section in which the flanks 28, 29 diverge. When it passes through the groove cam 27, the cam roller 26 hits one of the flanks 28, 29 in the first section 30 and is thus moved into the adjustment direction 15. The slide 13, which is connected to the cam roller 26, is moved together with the cam roller 26.

If a format adjustment is made in which the difference between the previous format width and the format width that is to be set is very big, multiple steps may be necessary to adjust every profile 8. In a first revolution of the profile 8, the two slides 13 of the respective profile 8 are adjusted towards or away from one another by a specified amount and in a following second revolution of the profile, they are moved by a specified further amount and in the same adjustment direction as in the first revolution. Between the two revolutions, the groove cam 27 is adjusted by a specified amount in the required adjustment direction. Due to the step-by-step adjustment, the groove cam 27 may be of comparatively compact construction in which the opening side of the first section 30 and the angle between the flanks 28, 29 in the first section 30 may be kept small. The adjustment amounts are selected so as to avoid any danger of the cam roller 26 hitting the groove cam 27 next to the groove cam opening between the flanks 28, 29.

A last step of a format adjustment is a fine-adjustment of the groove cam 27 with respect to the cam roller 26 to center the groove cam 27 relative to the cam roller 26 so that there is adequate space both between the right-hand flank 28 and the cam roller 26 and between the left-hand flank 29 and the cam roller 26. This centering fine-adjustment effectively prevents contact between the cam roller 26 and the groove cam 27 during normal operation of the machine, for instance during printing, because contact would lead to friction, wear, and start-up shocks.

The following is a summary list of reference numerals and the corresponding structure used in the above description of the invention:

1 printing machine
2 transport device
3 printing substrate
4 conveyor belt
5 print head
6 dryer
7 direction of transport
8 profile
9 roll
10 guide
11 direction of revolution
12 groove
13 slide
14 linear guide
15 adjustment direction
16 minimum format
17 first bore
18 longitudinal channel
19 second bore
20 longitudinal groove
21 rail
22 vacuum groove
23 connector
24 connecting channel
25 journal
26 cam roller
27 groove cam
28 right-hand flank
29 left-hand flank
30 first section
31 second section
A distance
D diameter

The invention claimed is:

1. A transport device for transporting printing substrates, the transport device comprising:

a conveyor belt having an inner side;

revolving profiles supporting said inner side of said conveyor belt, each of said profiles having grooves and at least one of said grooves having a first bore and a second bore;

a slide having a longitudinal groove;

said first bore having a vacuum applied thereto and said second bore being in air-conducting connection with said longitudinal groove causing suction air to flow out of said longitudinal groove through said at least one groove and into said first bore;

a groove cam for pushing said slide in an adjustment direction when said slide passes; and a cam roller fixed to said slide, said cam roller contacting said groove cam upon a format change.

2. The transport device according to claim 1, wherein said grooves extend in a direction parallel to a direction of revolution of said profiles.

3. The transport device according to claim 1, wherein said first bore of said at least one groove and said first bores of adjacent grooves form a first row and branch off a common longitudinal channel.

4. The transport device according to claim 3, wherein said grooves of said first row are located within a smallest format of the printing substrate able to be processed with the transport device.

5. The transport device according to claim 4, wherein said second bore of said at least one groove and said second bores of adjacent grooves form a second row extending so as to cover said longitudinal groove.

6. The transport device according to claim 5, wherein said grooves of said second row adjacent said at least one groove are outside of the smallest format of the printing substrate.

7. The transport device according to claim 1, wherein said groove cam has flanks, and said cam roller and said flanks are spaced apart from each other when said cam roller passes through said groove cam during normal machine operation.

8. The transport device according to claim 7, wherein said groove cam has a first section and a second section, and said flanks converge in said first section and are parallel to one another in said second section.

9. A printing machine, comprising:

a transport device according to claim 1; and at least one print head for inkjet printing, said at least one print head being oriented towards said transport device for printing on said printing substrate located on said transport device.

* * * * *